US006595326B1

(12) United States Patent
Dean

(10) Patent No.: US 6,595,326 B1
(45) Date of Patent: Jul. 22, 2003

(54) LADDER LEVELING DEVICE

(76) Inventor: Donald L. Dean, P.O. Box 342, Buffalo, TX (US) 75831-0342

( * ) Notice: Subject to any disclaimer, the term of this patent is extended or adjusted under 35 U.S.C. 154(b) by 0 days.

(21) Appl. No.: 10/135,021

(22) Filed: May 1, 2002

(51) Int. Cl.[7] ..... E06C 7/44
(52) U.S. Cl. ..... 182/204; 182/108
(58) Field of Search ..... 182/200–205, 182/207, 108, 107; 248/188.5

(56) References Cited

U.S. PATENT DOCUMENTS

| | | | | |
|---|---|---|---|---|
| 1,329,740 A | | 2/1920 | Barron | |
| 2,147,052 A | | 2/1939 | Noone | |
| 2,449,609 A | | 9/1948 | Linder et al. | |
| 2,936,849 A | * | 5/1960 | Larson | 182/204 |
| 3,173,512 A | | 3/1965 | Sturdy et al. | |
| 3,233,702 A | | 2/1966 | Feltrop | |
| 3,554,321 A | | 1/1971 | Stedman | |
| 3,948,352 A | * | 4/1976 | Larson et al. | 182/204 |
| 4,249,638 A | | 2/1981 | Fernandez | |
| 4,683,980 A | | 8/1987 | Vayko | |
| 4,807,720 A | | 2/1989 | Kim | |
| 5,044,468 A | | 9/1991 | Worthington, Jr. | |
| 5,771,992 A | | 6/1998 | Snyder | |
| 5,791,438 A | | 8/1998 | Kempton | |

* cited by examiner

*Primary Examiner*—Alvin Chin-Shue
(74) *Attorney, Agent, or Firm*—Donald R. Schoonover

(57) ABSTRACT

A ladder leveling device includes a unit attached to the leg of a ladder by a spring-loaded lock unit. A spring-biased bolt is manipulated to be accommodated in bolt-accommodating holes in the unit and in the frame of the ladder with the unit being slidably received on the frame of the ladder.

3 Claims, 2 Drawing Sheets

LADDER LEVELING DEVICE

BACKGROUND OF THE INVENTION

1. Field of the Invention

The present invention relates to the general art of ladders, and to the particular field of ladder leveling devices.

2. Discussion of the Related Art

In nearly any construction project, a worker is required to stand on a ladder to complete a job. This requirement applies to painters, plasterers, electricians, carpenters and the like. While standing on a ladder, the worker must balance himself as well as complete the job which may tend to unbalance his stance on the ladder. Any unbalance on a ladder is not desirable.

However, many construction sites have uneven ground. A ladder resting on such uneven ground may not be as stable or as steady as possible thus distracting the worker, or worse.

Therefore, there is a need for a ladder that can be made stable on all ground configurations.

Often, a ladder is used next to a stairway or even on a roof. In such cases, the ladder may have to rest on two distinct levels. Certainly, the ladder must be stable. However, in a multi-level situation, it may not be possible to support a ladder in a manner that is as stable as desirable.

Therefore, there is a need for a ladder that can be leveled and stabilized for a wide range of terrain and support surface configurations.

While there are many examples of ladder leveling devices in the art, many of these devices are not as successful as they could be because they are not easy to use, or are not as stable as possible. For example, if the leveling device is not as securely attached to the ladder as possible, it may slip or move which is not desirable. Also, if the leveling device is complicated, it may be prone to failure, or expensive or difficult to attach or use. In any of these cases, the device will have drawbacks that inhibit its acceptance. If the device is complicated, it may be susceptible to malfunctioning due to dirt or the like. Since many ladders are used in situations where there is a great deal of dirt and/or dust, if the leveling device is susceptible to malfunctioning due to dirt and/or dust, the device will have shortcomings that may prevent its acceptance. Also, if the device being used to level a ladder is heavy and bulky, a worker may not use it due to the difficulty of maneuvering either the device or the ladder with the device attached.

Still further, it is desirable for a ladder leveling device to be amenable for use with a wide variety of ladders. If a ladder must be specially designed to accommodate the ladder leveling device, the device may not be widely accepted. If a ladder must be specifically re-designed to accommodate a ladder leveling device, it is likely that the leveling device will not be used.

PRINCIPAL OBJECTS OF THE INVENTION

It is a main object of the present invention to provide a ladder leveling unit that is easily attached to the ladder.

It is another object of the present invention to provide a ladder leveling unit that is easily adjusted with respect to the ladder being leveled.

It is another object of the present invention to provide a ladder leveling unit that is secure and stable once attached.

It is another object of the present invention to provide a ladder leveling unit that is amenable for use with a wide variety of terrain configurations.

It is another object of the present invention to provide a ladder leveling unit that is easily used on a wide variety of ladders.

It is another object of the present invention to provide a ladder leveling unit that can be easily adapted to an existing ladder.

It is another object of the present invention to provide a ladder leveling unit that is not overly expensive.

It is another object of the present invention to provide a ladder leveling unit that is not overly bulky.

SUMMARY OF THE INVENTION

These, and other, objects are achieved by a ladder leveling unit that includes a leg unit having a plurality of spaced apart holes defined therethrough and a foot unit fixed thereon. The leg unit is attached to a ladder by a lock unit that includes a U-shaped bracket and a spring-loaded lock that has a spring-biased bolt with a handle on one end and a stop flange thereon. A U-shaped body mounts the bolt and has a stop element thereon for holding the bolt in a releasable configuration. Bolt-accommodating holes are defined in the unit and in the ladder and the bolt extends through a selected hole in the unit into a hole defined in the ladder to attach the leveling unit to the ladder at a selected position.

The unit of the present invention is easily attached to a ladder and permits a wide range of height selections to be made while being stably and securely held in the selected position. Once attached to a ladder, the leveling unit will be quite stable and thus the ladder will be stable.

DETAILED DESCRIPTION OF THE INVENTION

Other objects, features and advantages of the invention will become apparent from a consideration of the following detailed description and the accompanying drawings.

The ladder leveler embodying the present invention is easily and quickly attached to a ladder and then is easily adjusted whereby the ladder can be easily and quickly leveled. Once the ladder leveler is attached to the ladder, it is quite stable.

Figure 2:
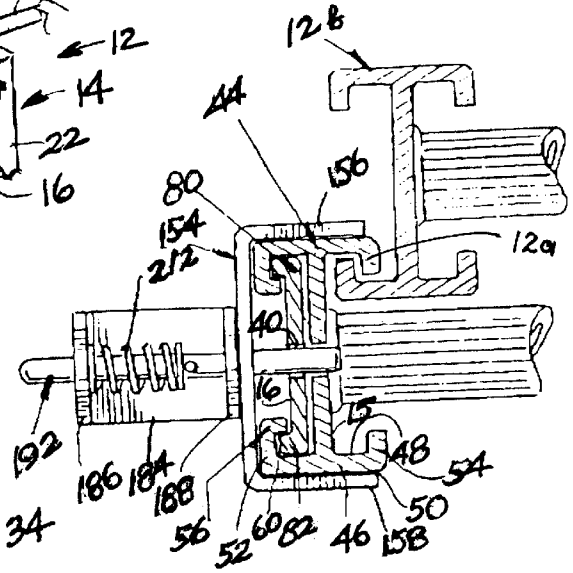
FIG. 2 is a plan view showing a ladder leveling unit of the present invention in place on a multiple-section ladder.
Figure 1:
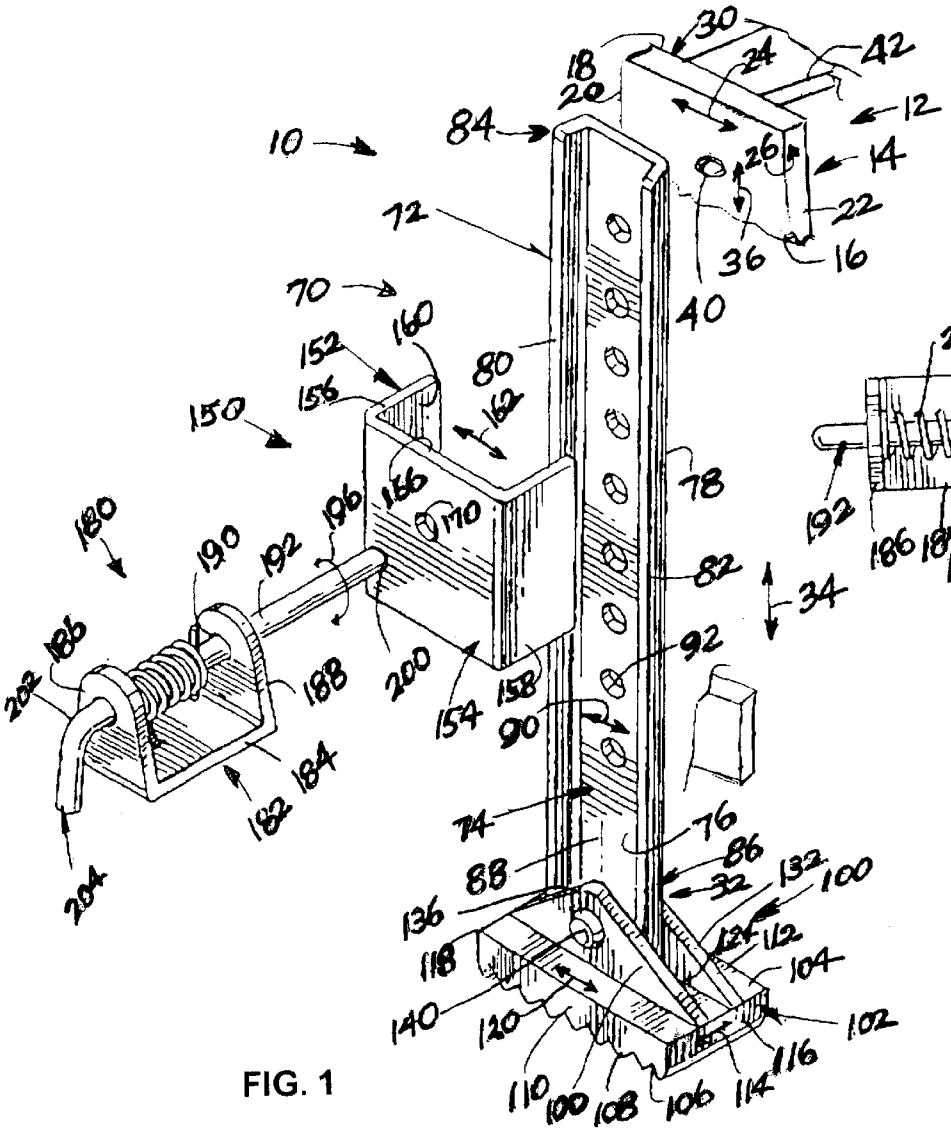
FIG. 1 is a perspective view showing the ladder leveling unit embodying the present invention.

Referring to the figures, it can be seen that the present invention is embodied in an attachment 10 for a ladder 12. Ladder 12 can be a single section ladder or a multiple section ladder as shown in FIG. 2 with first section 12*a* and second section 12*b* and further sections as will be understood by those skilled in the art.

Ladder 12 has two side frame elements, such as side frame element 14 with each side frame element including an outer surface 16, an inner surface 18, a first side edge 20, a second side edge 22, a width dimension 24 defined between first side edge 20 and second side edge 22, and a thickness dimension 26 defined between inner surface 18 and outer surface 16. Ladder 12 further includes a first end 30, a second end 32, and an axial dimension 34 extending between first end 30 and second end 32. Each side frame element 14 further includes a longitudinal axis 36 extending along the side frame element 14 between first end 30 of ladder 12 and second end 32 of ladder 12 in the direction of axial dimension 34 of ladder 12.

A bolt-accommodating hole 40 is defined through each side frame element 14 of ladder 12 from outer surface 16 to inner surface 18 of each side frame element 14.

Ladder 12 includes a plurality of ladder rungs, such as rung 42, extending between the side frame elements 14 and connecting the side frame elements 14 to each other. Ladder rungs 42 are spaced apart from each other along axial dimension 34 of ladder 12.

Each side frame element 14 includes a first ladder frame side edge element 44 on first side edge 20 and a second ladder frame side edge element 46 on the second side edge 22 of each side frame element 14. As shown in FIG. 2, each ladder frame side edge element 44 and 46 is on an associated side frame element 14 of the two side frame elements 14 of the ladder 12 and is oriented to extend essentially perpendicular to width dimension 24 of the associated side frame element 14 and to extend in the direction of thickness dimension 26 of the associated side frame element 14. Each ladder frame side edge element 44 and 46 has a inside surface 48 and an outside surface 50, a first end element 52 on one end thereof and a second end element 54 on a second end thereof. First and second end elements 52 and 54 of each ladder frame side edge element are oriented to extend along width dimension 24 of the associated side frame element 14 with first and second end elements 52 and 54 extending toward each other. First end element 52 is located adjacent to outer surface 16 of the associated side frame element and second end element 54 is located adjacent to inner surface 18 of the associated side frame element whereby the side frame element is located between the first and second end elements. Each frame side edge element further includes a third end element 56 on first end element 52. Third end element 56 is spaced apart from inside surface 48 of the associated side frame element and extends from first end element 52 toward outer surface 16 of the associated side frame element.

A channel 60 is defined by third end element 56, first end element 52 and inside surface 16 of ladder frame side edge element 46. It is noted that a channel is also defined by ladder frame side edge element 44 as well, but will not be described since the two elements are identical.

Attachment 10 further includes a ladder leveling unit 70 which includes an adjusting leg unit 72. Adjusting leg unit 72 includes a body 74 having a first surface 76 and a second surface 78, two side edge elements 80 and 82 on body 74 of the adjusting leg unit with body 74 and side edge elements 80 and 82 of adjusting leg unit 72 forming a U-shape. Body 74 further includes a first end 84 and a second end 86 with a longitudinal axis 88 of adjusting leg unit 72 extending between the first and second ends of the body 74 of the adjusting leg unit 72 and a width dimension 90 which extends between side edge elements 80 and 82 on body 74 of adjusting leg unit 72. Width dimension 90 of the adjusting leg unit is less than width dimension 24 of each of the side frame elements 14.

As can be seen in FIG. 2, side edge elements 80 and 82 of the adjusting leg unit are sized to be slidably received in channels 60 defined on side frame elements 44 and 46 of the ladder with longitudinal axis 88 of body 74 extending in the direction of longitudinal axis 36 of the associated side frame element of the ladder.

A plurality of bolt-accommodating holes, such as bolt-accommodating hole 92, are defined through body 74 of adjusting leg unit 72. The bolt-accommodating holes 92 of body 74 are spaced apart from each other along longitudinal axis 88 of body 74 of adjusting leg unit 72. Each of the bolt-accommodating holes 92 defined through the body 74 of the adjusting leg unit 72 is alignable with bolt-accommodating hole 92 defined through the associated side frame element when adjusting leg unit 70 is mounted on ladder 12.

Ladder leveling unit 70 further includes a foot unit 100 on second end 86 of body 74 of each leg adjusting unit and includes a base 102 having a top surface 104 and a ground-engaging surface 106 with a plurality of protrusions, such as protrusion 108, on ground-engaging surface 106 of base 102 of foot unit 100. Base 102 further includes a first side edge 110, a second side edge 112, a width dimension 114 extending between first side edge 110 and second side edge 112, a first end edge 116, a second end edge 118, and a length dimension 120 extending between the first and second end edges 116 and 118 of base 102 of foot unit 100. Width dimension 114 of base 102 of foot unit 100 extends in the direction of thickness dimension 26 of the associated side frame element 14, and width dimension 114 of base 102 is greater than thickness dimension 26 of the associated side frame element 14, and length dimension 120 of base 102 of foot unit 100 extends in the direction of width dimension 24 of the associated side frame element 14 with length dimension 120 being greater than width dimension 24 of the associated side frame element 14 so the base forms a stable support for the leveled ladder 12.

Foot unit 100 further includes a first triangular flange element 130 on top surface 104 of base 102 and extends along length dimension 120 of the base 102 of the foot unit 100. A second triangular flange element 132 is located on top surface 104 of base 102 of foot unit 100 and extends along length dimension 120 of base 102. First and second triangular flanges 130 and 132 are spaced apart from each other along width dimension 114 of base 102 and define a gap 134 therebetween. Each triangular flange element 130, 132 has an apex, such as apex 136 on flange element 130, spaced apart from top surface 104 of base 102. Gap 134 is sized to receive second end 86 of a leg adjusting unit 72 when foot unit 100 is attached to leg adjusting unit 72. A fastener 140 extends through first and second triangular flange elements 130 and 132 and through body 74 of leg adjusting unit 72 located in gap 134.

Attachment 10 further includes a locking unit 150 which includes a U-shaped bracket 152 having a body 154, first and second side flanges 156 and 158 each having an inner surface 160, and a width dimension 162 defined between inner surfaces 160 of first and second side flanges 156 and 158 of bracket 152 of locking unit 150. Width dimension 162 of bracket 152 of locking unit 150 is greater than width dimension 90 of each of the side frame elements 14 as can be seen in FIG. 2.

Body 154 of the bracket 152 has an inside surface 166 and a bolt-accommodating hole 170 is defined through body 154 of bracket 152 of locking unit 150.

As can be seen in FIG. 2, inner surface 160 of each of the first and second side flanges 156 and 158 of the U-shaped bracket 152 is fixedly attached, as by welding, or the like, to the outside surfaces of an associated ladder frame side element 14.

Bolt-accommodating hole 170 defined through body 154 of bracket 152 is aligned with bolt-accommodating hole 40 defined through the associated side frame element 14.

Locking unit 150 further includes a spring-loaded lock 180 having a U-shaped body 182 having a central portion 184 and first and second end flanges 186 and 188. A bolt-accommodating hole, such as bolt-accommodating hole 190, is defined through each of the first and second end flanges 186 and 188 of body 182 of spring-loaded lock 180. A bolt 192 extends through the bolt-accommodating holes defined through each end flange of body 182 of spring-loaded lock 180 and is rotatably mounted on the first and second end flanges 186 and 188 of the body 182 of the spring-loaded lock 180 to rotate in directions 196. Bolt 192 has a distal end 200, a proximal end 202, and a handle 204 on proximal end 202. Distal end 200 of bolt 192 extends away from second end flange 188 of the body 182 of the spring-loaded lock 180, and handle 204 is located adjacent to first end flange 186 of the body 182 of the spring-loaded lock 180.

Figure 3:
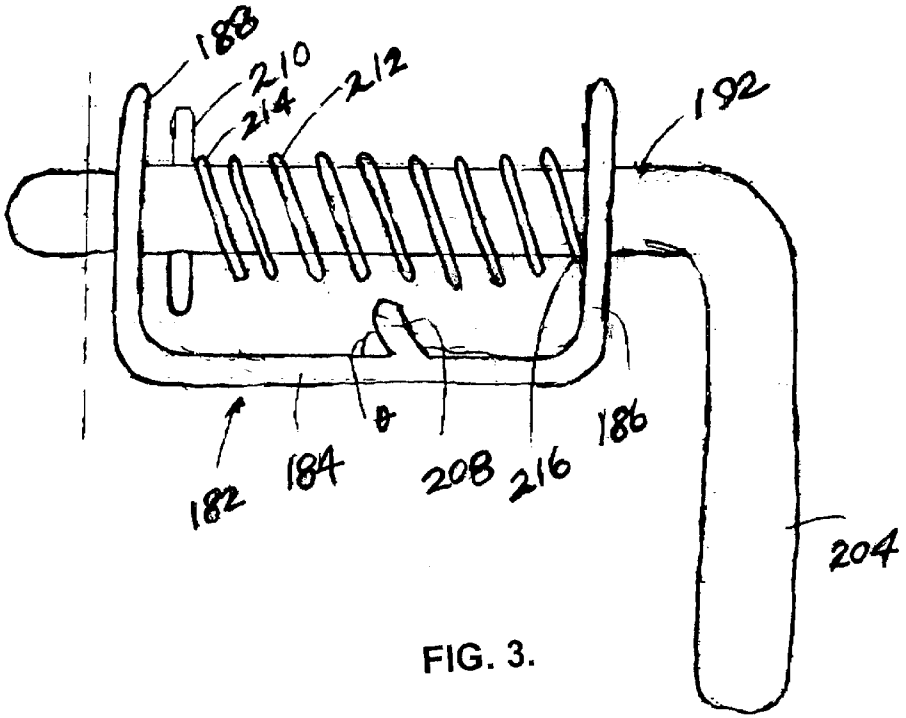
FIG. 3 is an enlarged elevational view of a spring-loaded locking unit of the ladder leveling unit of the present invention.

As shown in FIG. 3, a stop element 208 is located on central portion 184 of body 182 of the spring-loaded lock 180 between first and second end flanges 186 and 188 of body 182 of the spring-loaded lock 180. A stop flange 210 is mounted on bolt 192 between first and second end flanges 186 and 188 of body 182 of the spring-loaded lock 180. A compression spring 212 is located on bolt 192 of the spring-loaded lock 180 and has one end 214 thereof abutting stop flange 210 of the spring-loaded lock 180 and another end 216 abutting first end flange 186 of the body 182 of the spring-loaded lock 180.

As shown in FIG. 2, second end flange 188 of body 182 of the spring-loaded lock 180 is mounted, as by welding or the like, on body 154 of U-shaped bracket 152 of locking unit 150.

Bolt 192 of spring-loaded lock 180 extends through the bolt-accommodating holes defined through each end flange 186 and 188 of the body of the spring-loaded lock 180 and through bolt-accommodating hole 170 in body 154 of U-shaped bracket 152 and through a selected one of the bolt-accommodating holes 92 defined through leg adjusting unit 72 and through bolt-accommodating hole 40 defined through the associated side frame element 14 when leveling unit 70 is attached to ladder 12.

Stop flange 210 and stop element 208 of spring-loaded lock 180 are located to space distal end 200 of bolt 192 away from body 74 of adjusting leg unit 72 of ladder leveling unit 70 when stop flange 210 is in abutting contact with stop element 208. Stop element 208 is oriented to form an acute angle e with central portion 184 of body 182 of spring-loaded lock 180. The angle θ and the shape and size of the stop flange 210 permit the stop flange 210 to pass by the stop element 208 when handle 204 is manipulated and rotated, but will abut the stop element 208 when the handle 204 is manipulated in another direction. This will hold the bolt 192 in position to move the locking unit 150 to the desired location on the ladder and then will permit the bolt 192 to move into a locking configuration as shown in FIG. 2 when the desired location is achieved.

The acute angle for angle θ an be a right angle if desired.

Figure 4:
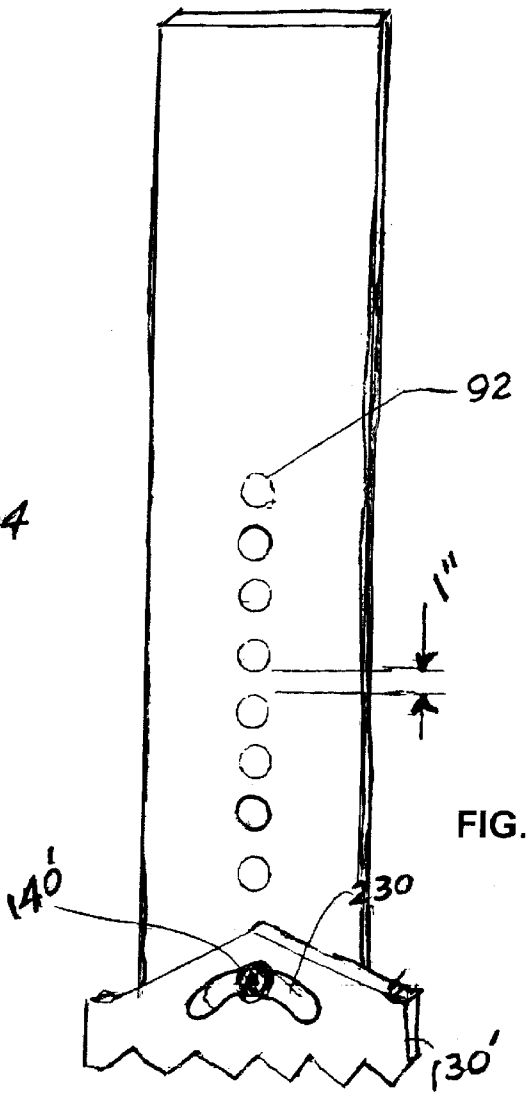
FIG. 4 is an alternative form of the ladder leveling unit of the present invention.

As shown in FIG. 4, an arcuate cutout 230 can be defined through the triangular flange elements, such as triangular flange element 130', to permit further adjustment of the attachment. Fastener 140' can include screw threads to assure a secure attachment between the fastener and the flanges.

It is understood that while certain forms of the present invention have been illustrated and described herein, it is not to be limited to the specific forms or arrangements of parts described and shown.

I claim:

1. An attachment for a ladder comprising:

a) a ladder having (1) two side frame elements, each side frame element including an outer surface, an inner surface, a first side edge, a second side edge, a width dimension defined between the first side edge and the second side edge, a thickness dimension defined between the inner surface and the outer surface, (2) a first end, (3) a second end, (4) an axial dimension extending between the first end and the second end, (5) a longitudinal axis on each side frame element extending along the side frame element between the first end of said ladder and the second end of said ladder in the direction of the axial dimension of said ladder, (6) a bolt-accommodating hole defined through each side frame element of said ladder from the outer surface to the inner surface of each side frame element, (7) a plurality of ladder rungs extending between the side frame elements and connecting the side frame elements to each other, the ladder rungs being spaced apart from each other along the axial dimension of said ladder, (8) a first ladder frame side edge element on the first side edge of each side frame element, a second ladder frame side edge element on the second side edge of each side frame element, each ladder frame side edge element being on an associated side frame element of the two side frame elements of said ladder and oriented to extend essentially perpendicular to the width dimension of the associated side frame element and to extend in the direction of the thickness dimension of the associated side frame element, each ladder frame side edge element having (A) a inside surface and an outside surface, (B) a first end element on one end thereof, (C) a second end element on a second end thereof, (D) the first and second end elements of each ladder frame side edge element being oriented to extend along the width dimension of the associated side frame element with the first and second end elements extending toward each other, the first end element being located adjacent to the outer surface of the associated side frame element and the second end element being located adjacent to the inner surface of the associated side frame element whereby the side frame element is located between the first and second end elements, (E) a third end element on the first end element, the third end element being spaced apart from the inside surface of the associated side frame element and extending from the first end element toward the outer surface of the associated side frame element, and (F) a channel defined by the third end element, the first end element, and the inside surface of the ladder frame side edge element;

b) a ladder leveling unit which includes (1) an adjusting leg unit which has (A) a body having a first surface and a second surface, two side edge elements on the body of the adjusting leg unit with the body and the side edge elements of the adjusting leg unit forming a U-shape, a first end of the body of the adjusting leg unit, a second end of the body of the adjusting leg unit, a longitudinal axis of the adjusting leg unit extending between the first and second ends of the body of the adjusting leg unit, a width dimension of the adjusting leg unit which extends between the side edge elements on the body of the adjusting leg unit, (B) the width dimension of the adjusting leg unit being less than the width dimension of each of the side frame elements, (C) the side edge elements of the adjusting leg unit being sized to be slidably received in the channels defined on the side frame elements of said ladder with the longitudinal axis of the body of the adjusting leg unit extending in the direction of the longitudinal axis of the associated side frame element of the ladder, (D) a plurality of bolt-accommodating holes defined through the body of the adjusting leg unit, the bolt-accommodating holes of the body of the adjusting leg unit being spaced apart from each other along the longitudinal axis of the body of the adjusting leg unit, and (E) each of the bolt-accommodating holes defined through the body of the adjusting leg unit being alignable with a bolt-accommodating hole defined through the associated side frame element when the adjusting leg unit is mounted on said ladder;

c) a foot unit on the second end of the body of each leg adjusting unit and including (1) a base having (A) a top surface and a ground-engaging surface, (B) a plurality of protrusions on the ground-engaging surface of the base of said foot unit, (C) a first side edge, (D) a second side edge, (E) a width dimension extending between the first side edge of the base of said foot unit and the second side edge of the base of said foot unit, (F) a first end edge (G) a second end edge, (H) a length dimension extending between the first and second end edges of the base of said foot unit, (I) the width dimension of the base of said foot unit extending in the direction of the thickness dimension of the associated side frame element, the width dimension of the base of said foot unit being greater than the thickness dimension of the associated side frame element, (J) the length dimension of the base of said foot unit extending in the direction of the width dimension of the associated side frame element, the length dimension of the base of said foot unit being greater than the width dimension of the associated side frame element, (2) a first triangular flange element on the top surface of the base of said foot unit and extending along the length dimension of the base of said foot unit, (3) a second triangular flange element on the top surface of the base of said foot unit and extending along the length dimension of the base of said foot unit, (4) the first and second triangular flanges of said foot unit being spaced apart from each other along the width dimension of the base of said foot unit and defining a gap therebetween, (5) each triangular flange element having an apex spaced apart from the top surface of the base of said foot unit, (6) the gap being sized to receive the second end of a leg adjusting unit when said foot unit is attached to the leg adjusting unit, and (7) a fastener extending through the first and second triangular flange elements and through the body of the leg adjusting unit located in the gap; and d) a locking unit which includes (1) a U-shaped bracket having (A) a body, (B) first and second side flanges each having an inner surface, (C) a width dimension defined between the inner surfaces of the first and second side flanges of the bracket of said locking unit, the width dimension of the bracket of said locking unit being greater than the width dimension of each of the side frame elements, (D) an inside surface of the body of the U-shaped bracket of said locking unit, (E) a bolt-accommodating hole defined through the body of the bracket of said locking unit, (F) the inner surface of each of the first and second side flanges of the U-shaped bracket being fixedly attached to the outside surfaces of an associated ladder frame side element, and (G) the bolt-accommodating hole defined through the body of the bracket of said locking unit being aligned with the bolt-accommodating hole defined through the associated side frame element, and (2) a spring-loaded lock having (A) a U-shaped body having a central portion and first and second end flanges, (B) a bolt-accommodating hole defined through each of the first and second end flanges of the body of the spring-loaded lock, (C) a bolt extending through the bolt-accommodating holes defined through each end flange of the body of the spring-loaded lock and being rotatably mounted on the first and second end flanges of the body of the spring-loaded lock and having (I) a distal end, (ii) a proximal end, (iii) a handle on the proximal end, (iv) the distal end of the bolt extending away from the second end flange of the body of the spring-loaded lock, and (v) the handle being located adjacent to the first end flange of the body of the spring-loaded lock, (D) a stop element located on the central portion of the body of the spring-loaded lock between the first and second end flanges of the body of the spring-loaded lock, (E) a stop flange on the bolt between the first and second end flanges of the body of said spring-loaded lock, (F) a compression spring located on the bolt of the spring-loaded lock and having one end thereof abutting the stop flange of said spring-loaded lock and another end abutting one of the first and second end flanges of the body of said spring-loaded lock, (G) the second end flange of the body of the spring-loaded lock being mounted on the body of the U-shaped bracket of said locking unit, (H) the bolt of the spring-loaded lock extending through the bolt-accommodating holes defined through each end flange of the body of the spring-loaded lock and through the bolt-accommodating hole in the body of the U-shaped bracket and through a selected one of the bolt-accommodating holes defined through the leg adjusting unit and through the bolt-accommodating hole defined through the associated side frame element when said leveling unit is attached to said ladder, (I) the stop flange and the stop element of the spring-loaded lock being located to space the distal end of the bolt away from the body of the adjusting leg unit of said ladder leveling unit when the stop flange is in abutting contact with the stop element, (J) the stop element being oriented to form an acute angle with the central portion of the body of said spring-loaded lock, and (K) the stop flange and the stop element being sized and shaped to permit the stop flange to move past the stop element when the bolt is rotated and moved in one direction and to abuttingly engage each other when the bolt is moved in a second direction.

2. The attachment for a ladder as described in claim 1 further including a second section for said ladder.

3. The attachment for a ladder as described in claim 1 further including an arcuate hole defined through each end flange of the body of said spring-loaded lock with the bolt extending through the arcuate holes and having a locking nut thereon.

* * * * *